US005312228A

United States Patent [19]

De Jong et al.

[11] Patent Number: 5,312,228

[45] Date of Patent: May 17, 1994

[54] SHIP'S PROPELLER

[75] Inventors: Karel De Jong, Groningen; Jacob De Vries, Hoogezand; Johan A. Sparenberg, Paterswolde, all of Netherlands

[73] Assignee: Stichting Voor De Technische Wetenschappen, Groningen, Netherlands

[21] Appl. No.: 836,013

[22] PCT Filed: Nov. 15, 1989

[86] PCT No.: PCT/NL89/00083

§ 371 Date: Feb. 26, 1992

§ 102(e) Date: Feb. 26, 1992

[87] PCT Pub. No.: WO91/07313

PCT Pub. Date: May 30, 1991

[51] Int. Cl.[5] ..... B63H 1/16

[52] U.S. Cl. ..... 416/191; 416/228; 416/237

[58] Field of Search ..... 416/191, 228, 235, 237, 416/238

[56] References Cited

U.S. PATENT DOCUMENTS

| | | | |
|---|---|---|---|
| 1,515,268 | 11/1924 | Morrow | 416/228 |
| 1,703,412 | 2/1929 | Thompson . | |
| 2,086,307 | 7/1937 | Stewart | 416/237 |
| 2,104,306 | 1/1938 | McLeod | 416/237 |
| 4,875,831 | 10/1989 | Fetiveau | 416/228 |

FOREIGN PATENT DOCUMENTS

| | | | |
|---|---|---|---|
| 899180 | 12/1953 | Fed. Rep. of Germany . | |
| 2337661 | 8/1977 | France . | |
| 2468499 | 5/1981 | France . | |
| 18596 | 1/1982 | Japan | 416/237 |
| 58-194689 | 11/1983 | Japan . | |
| 16201 | 10/1889 | United Kingdom | 416/237 |
| 4888 | 1/1890 | United Kingdom | 416/236 |
| 262349 | 12/1926 | United Kingdom . | |

OTHER PUBLICATIONS

"Flugtechnik Mehr Auftrieb-weniger Winderstand", *Technische Rundschau*, vol. 73, No. 10, Mar. 3, 1981, By V. S. Iselin, pp. 26-27.

*Primary Examiner*—Edward K. Look
*Assistant Examiner*—James A. Larson
*Attorney, Agent, or Firm*—Young & Thompson

[57] ABSTRACT

Ship's propeller having a propeller blade having a leading edge and a trailing edge and a free end, and end plates at the free end extending transversely of the blade on both sides of the blade. The line of attachment to the blade of each of the end plates has a chord length less than the chord length of the blade end and the lines of attachment of the end plates overlap each other partly, one end plate extending to the blade leading edge and the other end plate extending to the blade trailing edge. The end plates have airfoil configuration and have leading edges that extend outwardly and rearwardly of the blade with respect to the direction of movement of the blade.

4 Claims, 3 Drawing Sheets

SHIP'S PROPELLER

The present invention relates to a ship's propellar provided with propeller blades with end plates at the end remote from the propeller hub and on both sides of the blade.

Such a ship's propeller is known. The end plates at the tip of the propeller blades aim to distribute the free vortices coming from the tip of the blade transversely of the end plate, so that the kinetic energy losses incurred by these free tip vortices remain as low as possible. The end plates however have an important disadvantage. Since they are moved with relatively large speed by the liquid, they tend to have a large friction resistance. The energy losses incurred by this friction resistance can be so large that the mentioned energy profit is counteracted. It is also known to provide the blades of a ship's propeller at one side of the tip with an end plate. In order to distribute also in this case the tip vortices in the same direction, the width of this endplate must be equal to the sum of the widths of the plates present on both sides of the tip. Also in this case the friction resistance with respect to the water will be considerable.

The invention aims to provide a propeller with end plates at the blade tips, which has a lower friction resistance with respect to the water than the known propeller.

This is obtained, in that at the attachment to the blade the end plates have a chord length less than the chord length of the blade end and are overlapping each other partly, whereby one end plate is extending to one blade edge and the other end plate is extending to the other blade edge.

Since the bound vortices in chord direction are distributed over the blade tip, the whole blade tip must be covered by one or two end plates in order to obtain the desired effect.

According to the invention these vortices are not always distributed over two end plates, such as in the prior art, but substantially over one end plate. The bound vortices present in chord direction at the front side of the blade are namely discharged by the end plate extending to the front edge and the vortices at the back side of the blade by the end plate extending to the back edge. By equalizing the sum of the widths of the end plates with that of both known end plates or with the width of the single end plate the same favourable distribution of the discharge vortices transversely is obtained. Since however the width of each end plate according to the invention is smaller than that of the known single end plate, and its chord length is smaller than the chord length of the known double end plate, a considerable surface decrease is obtained by the end plates according to the invention with about a factor of 0.4. Since moreover the end plates in the intermediate area of the blade tip overlap each other, it is obtained that in this area the vortex of the blade tip can be distributed over both end plate halves, in such a way that on the front and back edges of these halves the bound vortex strength can go smoothly to zero to avoid danger of cavitation.

The ship's propeller can be carried out in such a way that at the attachment the chord length of each end plate is between 90% and 45% of that of the blade tip. It is preferred however that at the attachment the chord length of each end plate is between 70% and 45% of that of the blade tip.

The smallest surface area of both end plates is obtained if at attachment the chord lengths of both end plates are the same.

An especially favourable effect can be obtained if the form of the propeller is optimalized in the way as disclosed in International Ship building Progress, part 34, July 1987 Nr. 395, (An optimum screw propeller with end plates) by J. A. Sparenberg and J. de Vries. The there determined optimal circulation distribution with respect to a propeller provided with end plates can now be applied to determine the further form of the end plates according to the invention. The chord lengths of the end plates are chosen proportional to said optimal circulation distribution, so that danger of cavitation owing to too large underpressures is avoided. In this respect it is remarked that not the position or angle with respect to the flow of front edge and back edge of the end plate halves are important, but the chord lengths of the end plates.

Finally it is remarked that it is not important whether the front end plate is present at the high pressure or at the low pressure side, provided the back half is present at the other side of the blade.

The invention will now be explained with reference to an embodiment.

FIGS. 1*a*, 1*b* show respectively a side and front view of the end of a propeller blade with end plates.

Figure 4A:
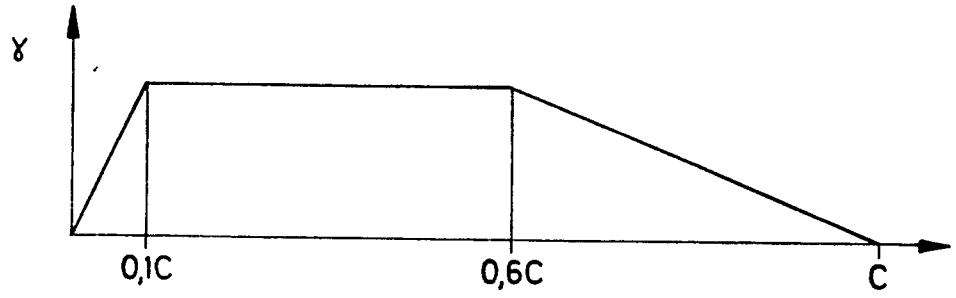
Figure 4B:
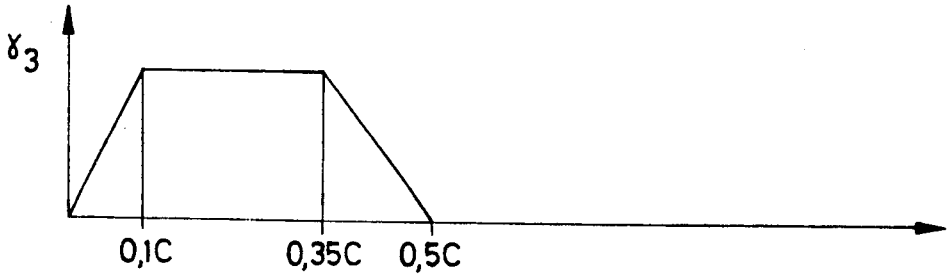
Figure 4C:
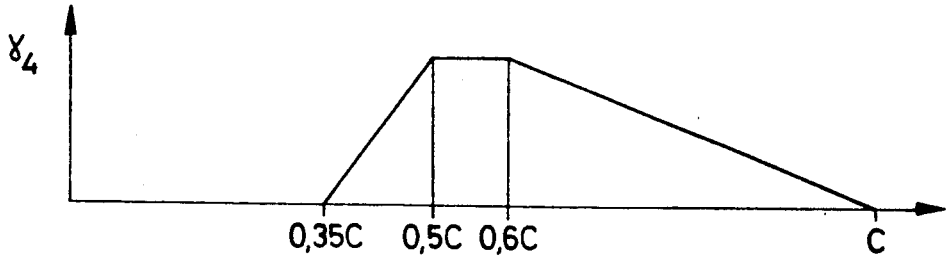

FIGS. 4*a*, 4*b* and 4*c* show graphically an assumed course of the bound vortex strength over respectively blade and end plates.

Figure 1A:
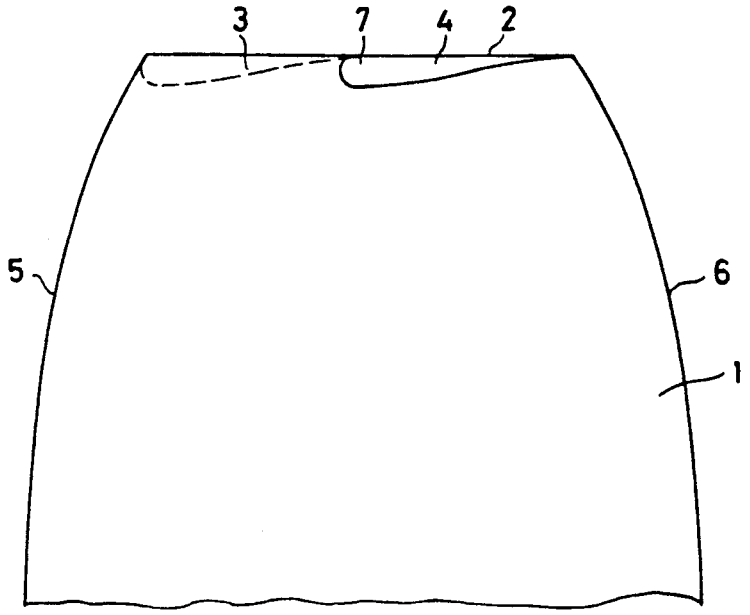
Figure 1B:
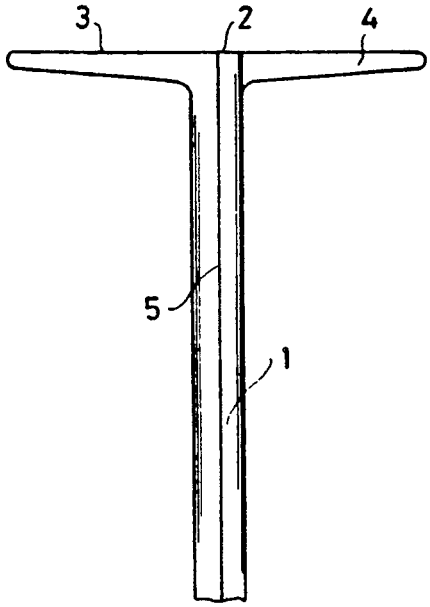

The propeller blade 1 shown in FIGS. 1*a*, 1*b* is at its end (not shown) attached to the hub (not shown) and at its other end 2 provided with two end plates 3, 4. These end plates have at the side of the end 2 of the blade a chord length which is smaller than the chord length of that end. The end plate 3 is at its front adjacent to the front edge 5 of the propeller blade, the end plate 4 is at its rear adjacent to the rear edge 6 of the propeller blade. In the intermediate area 7 of the end 2 the end plates 3, 4 are overlapping each other, as is clear from FIG. 2.

Figure 2:
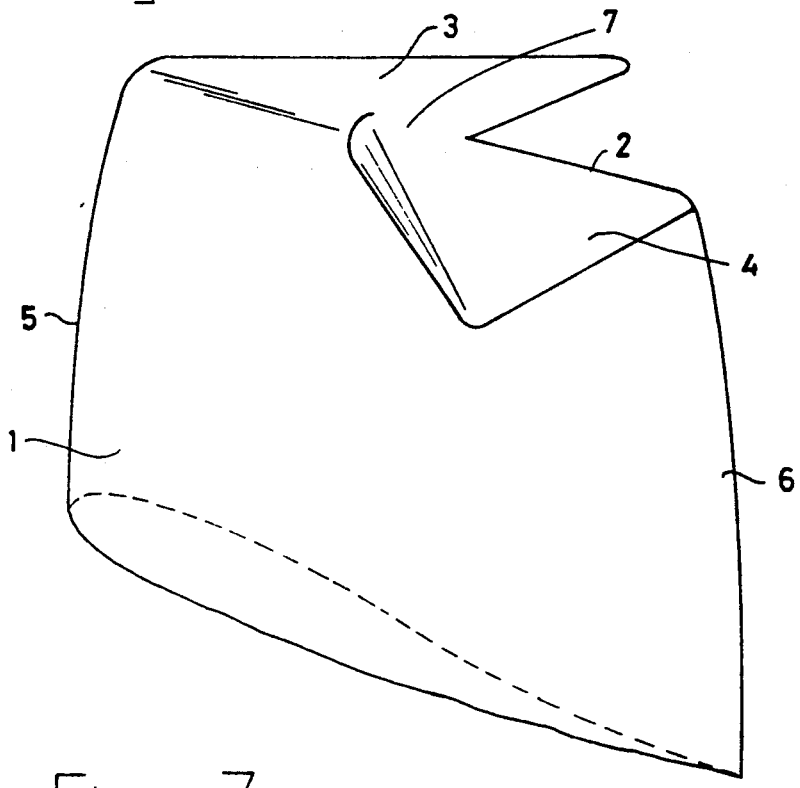
FIG. 2 shows the propeller blade according to FIGS. 1*a*, 1*b* in perspective.
Figure 3:
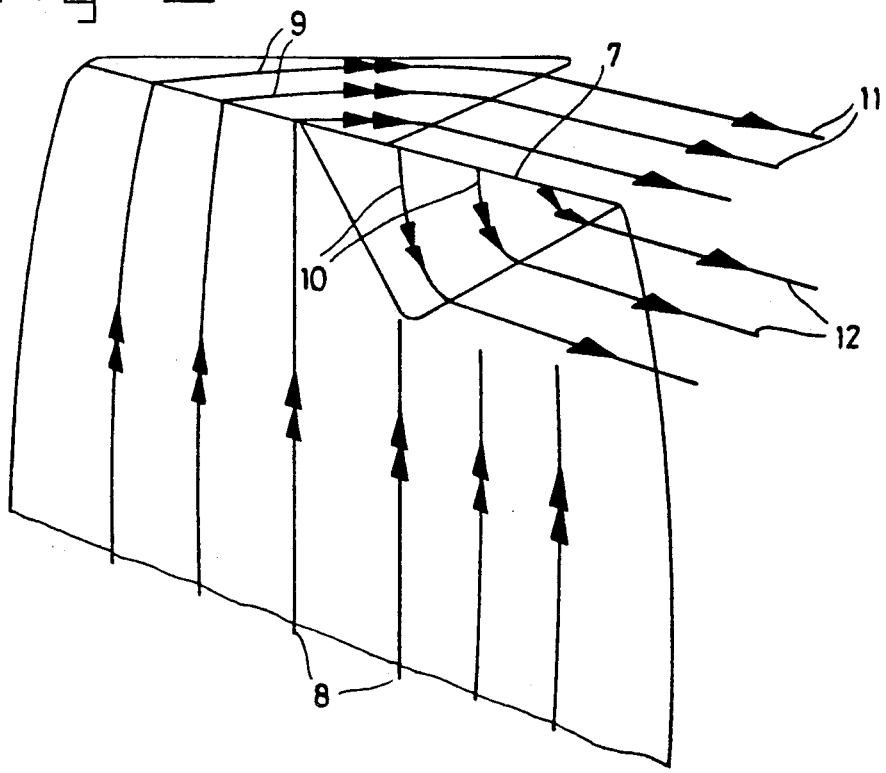
FIG. 3 shows the vortex model of the propeller blade according to FIG. 2.

In the vortex model shown in FIG. 3 (seen at the same angle as FIG. 2) the propeller blade is indicated by the bound vortices 8 and the end plates 3, 4 by the bound vortices 9, 10. These last vortices continue in the free vortices 11 respectively 12. As known the free vortices 11, 12 distributed in such a way give rise to lower losses of kinetic energy compared with a more concentrated tip vortex which in general is formed at propeller blades without end plates. From this figure it is clear that the end plates 3, 4 do not need to extend over the whole chord length of the end 2, the vortices 8 present at the front of the blade are guided away as vortices 9 of the end plate 3, the vortices present on the rear of the blade as vortices 10 of the end plate 4.

In FIG. 4 an example of an assumed course of the bound vortex strength over the blade tip chord c is indicated and from the front and to the rear end seen in the flow direction. In FIG. 4*b*, *c* the assumed course is indicated of the bound vortex strength 3 respectively 4 of the front end plate and the rear end plate, as well as over the chord of the blade end. At the overlapping of both end plates here assumed between 0.35 c and 0.5 c a linear course is possible. Further to both end plates equal vortex strength must be discharged. The above mentioned can be obtained if the following two conditions are satisfied:

1e) $\gamma=\gamma_3+\gamma_4$ 2e) surface figure 4c, which is to say that FIG. 4a equals the sum of FIGS. 4b and 4c.

It is also to be noted from FIGS. 1a and 2 that the end plates 3 and 4 are of airfoil configuration and are swept back in the sense that their leading edges extend rearwardly outwardly of the blade relative to the direction of movement of the blade.

We claim:

1. Ship's propeller having a propeller blade having a leading edge and a trailing edge and a free end, and end plates at said free end extending transversely of the blade on both sides of the blade, the line of attachment to the blade of each of the end plates having a chord length less than the chord length of the blade end and the lines of attachment of the end plates overlapping each other partly, one end plate extending to the blade leading edge and the other end plate extending to the blade trailing edge.

2. Ship's propeller according to claim 1, wherein the length of the line of attachment of each end plate is between 90% and 45% of the chord length of the blade tip.

3. Ship's propeller according to claim 1, wherein the length of the line of attachment of each end plate is between 70% and 45% of the chord length of the blade tip.

4. Ship's propeller according to claim 1, wherein the lengths of the lines of attachment of both end plates are the same.

* * * * *